US009315198B2

(12) United States Patent
Bavaresco et al.

(10) Patent No.: US 9,315,198 B2
(45) Date of Patent: Apr. 19, 2016

(54) CABLE TRANSPORTATION SYSTEM BOGIE, AND CABLE TRANSPORTATION SYSTEM COMPRISING SUCH A BOGIE

(71) Applicant: ROPFIN B.V., Leimuiden (NL)

(72) Inventors: Federico Bavaresco, Fie' Allo Sciliar (IT); Franco Coco, Laives (IT); Alain Mollet, Annecy le Vieux (FR); Giuseppe Conte, Bolzano (IT)

(73) Assignee: ROPFIN B.V., Leimuiden (NL)

( * ) Notice: Subject to any disclaimer, the term of this patent is extended or adjusted under 35 U.S.C. 154(b) by 225 days.

(21) Appl. No.: 13/875,866

(22) Filed: May 2, 2013

(65) Prior Publication Data

US 2014/0305331 A1 Oct. 16, 2014

(30) Foreign Application Priority Data

Apr. 12, 2013 (IT) ..... MI2013A0609

(51) Int. Cl.

| | |
|---|---|
| ***B61B 9/00*** | (2006.01) |
| ***B61F 3/12*** | (2006.01) |
| ***B61F 5/22*** | (2006.01) |

(52) U.S. Cl.

CPC . *B61B 9/00* (2013.01); *B61F 3/125* (2013.01); *B61F 5/22* (2013.01)

(58) Field of Classification Search

CPC ..... B61B 12/10; B61B 12/105; B61B 12/12; B61B 12/125; B61B 12/127; B61B 9/00; B61B 13/08; B61F 5/22

See application file for complete search history.

(56) References Cited

U.S. PATENT DOCUMENTS

| | | | | |
|---|---|---|---|---|
| 1,386,534 | A * | 8/1921 | Rogers | 104/235 |
| 3,190,235 | A * | 6/1965 | Bertin et al. | 104/134 |
| 3,812,788 | A * | 5/1974 | Laurent | 104/130.09 |
| 3,915,094 | A * | 10/1975 | Sawada et al. | 104/130.07 |
| 4,550,663 | A * | 11/1985 | DeViaris | 104/119 |
| 4,716,838 | A * | 1/1988 | Huon De Kermadec et al. | 104/173.1 |
| 5,406,891 | A * | 4/1995 | Kunczynski | 104/173.1 |
| 5,419,261 | A * | 5/1995 | Tarassoff et al. | 104/173.1 |
| 5,595,122 | A * | 1/1997 | Levi et al. | 104/173.1 |
| 5,732,635 | A * | 3/1998 | McKoy | 104/73 |
| 5,819,668 | A * | 10/1998 | Meindl | 104/168 |
| 6,024,022 | A * | 2/2000 | Toyre | 104/173.1 |
| 6,108,596 | A * | 8/2000 | Beike | 701/19 |
| 6,321,657 | B1 * | 11/2001 | Owen | 104/119 |
| 8,418,625 | B2 * | 4/2013 | Czaloun | 104/204 |
| 2001/0017092 | A1 * | 8/2001 | Mollet | 104/23.2 |
| 2001/0037747 | A1 * | 11/2001 | Svensson | 104/120 |
| 2002/0035947 | A1 * | 3/2002 | Sebata et al. | 105/199.2 |
| 2010/0180792 | A1 * | 7/2010 | Bavaresco et al. | 104/178 |

(Continued)

FOREIGN PATENT DOCUMENTS

| | | | |
|---|---|---|---|
| EP | 0673818 | A1 | 9/1995 |
| EP | 0773151 | A1 | 5/1997 |

(Continued)

*Primary Examiner* — Jason C Smith

(74) *Attorney, Agent, or Firm* — Neal, Gerber & Eisenberg LLP

(57) ABSTRACT

A cable transportation system bogie extends along a longitudinal axis and has a main frame defining a supporting surface; a platform configured to support at least one car; and an articulated mechanism connected to the main frame and the platform, and configured to transmit pulling force between the main frame and the platform, and to permit movement of the platform with respect to the main frame in any direction.

21 Claims, 6 Drawing Sheets

(56) References Cited

U.S. PATENT DOCUMENTS

| | | | | |
|---|---|---|---|---|
| 2011/0226152 | A1* | 9/2011 | Mollet | 104/178 |
| 2012/0017797 | A1* | 1/2012 | Mollet et al. | 104/130.01 |
| 2012/0090497 | A1* | 4/2012 | Fischer et al. | 104/130.06 |
| 2012/0118194 | A1* | 5/2012 | Schneider et al. | 105/171 |
| 2012/0125222 | A1* | 5/2012 | Heinzle et al. | 104/202 |
| 2012/0227617 | A1* | 9/2012 | Schneider | 105/199.2 |
| 2013/0180427 | A1* | 7/2013 | Shinmura et al. | 105/199.1 |
| 2013/0319284 | A1* | 12/2013 | Shinmura et al. | 105/453 |
| 2014/0013992 | A1* | 1/2014 | Mollet et al. | 104/178 |
| 2014/0020595 | A1* | 1/2014 | Shinagawa | 105/199.1 |
| 2014/0305331 | A1* | 10/2014 | Bavaresco et al. | 104/173.1 |

FOREIGN PATENT DOCUMENTS

| | | | | |
|---|---|---|---|---|
| EP | 2455268 | A1 | 5/2012 | |
| FR | 2658772 | A1 * | 8/1991 | B61B 9/00 |

* cited by examiner

CABLE TRANSPORTATION SYSTEM BOGIE, AND CABLE TRANSPORTATION SYSTEM COMPRISING SUCH A BOGIE

PRIORITY CLAIM

This application dams the benefit of and priority to Italian Patent Application No. MI2013A 000609, filed on Apr. 12, 2013, the entire contents of which are incorporated by reference herein.

BACKGROUND

One known cable transportation system bogie is described in European Patent No. 2,455,268 A1, in which the bogie comprises a main frame connected to the haul cable; a platform supporting a car; and a block of elastomer interposed between the main frame and the platform.

Increasing use of transportation systems, particularly for city transport, has led to increased demand for improved passenger comfort, which known cable transportation system bogies fail to satisfy.

SUMMARY

The present disclosure relates to a cable transportation system bogie.

More specifically, the present disclosure relates to a cable transportation system bogie configured to support at least one car and connected to rails defining a designated or given track along which to move the car and the bogie.

It is one advantage of the present disclosure to provide a bogie for cable transportation systems which is configured to greatly enhance passenger comfort.

According to the present disclosure, there is provided a bogie for a cable transportation system, the bogie extending along a longitudinal axis and comprising a main frame defining a supporting surface; a platform connectable to at least one car; and an articulated mechanism connected to the main frame and the platform, and configured to transmit pulling force between the main frame and the platform, and to permit movement of the platform with respect to the main frame in any direction.

By virtue of the present disclosure, the articulated mechanism provides for transmitting pulling force between the main frame and the platform without compromising the freedom of movement, within designated or given limits, of the platform with respect to the main frame. In other words, the articulated mechanism enables the platform to move to and from the main frame, to move laterally with respect to the main frame, to move back and forth with respect to the main frame, to pitch with respect to the main frame, and to roll with respect to the main frame.

In one embodiment of the present disclosure, the bogie comprises a plurality of suspensions arranged on the supporting surface of the main frame, located between the main frame and the platform, and configured to absorb forces perpendicular to the supporting surface, and to adjust the platform with respect to the main frame.

The suspensions between the main frame and the platform provide for improving passenger comfort in the car and, to a certain extent, for limiting movement of the platform with respect to the main frame.

In certain embodiments, the suspensions are four in number or quantity and equally spaced along the interface between the main frame and the platform.

In one embodiment of the present disclosure, the suspensions are height-adjustable according to the passenger load. In one such embodiment, the suspensions are automatically height-adjustable according to the passenger load.

In one embodiment, the bogie comprises a plurality of shock absorbers between the main frame and the platform to decelerate movements perpendicular to the supporting surface.

Again for the purpose of improving passenger comfort, the shock absorbers are arranged close to the suspensions.

In one embodiment of the present disclosure, the bogie comprises a plurality of lateral shock absorbers located between the main frame and the platform and configured to decelerate movements crosswise to the longitudinal axis and parallel to the supporting surface.

In the present disclosure, lateral movements of the platform are also controlled and to a certain extent limited by the lateral shock absorbers.

In one embodiment of the present disclosure, the bogie comprises at least one (and in one embodiment two) torsion bars, each connected to the main frame and the platform.

The torsion bar also serves to limit movement of the platform with respect to the main frame. More specifically, the torsion bar serves to limit roll of the platform.

In one embodiment, the articulated mechanism comprises a longitudinal bar connected to the main frame and the platform by two respective universal joints.

Accordingly, the articulated mechanism may conveniently be made from a small quantity or number of component parts.

In one embodiment of the present disclosure, the platform comprises a first and second auxiliary frame arranged successively along the longitudinal axis to support a first and second car respectively.

Dividing the platform into a first and second auxiliary frame permits movement between the first and second car for relatively greater passenger comfort.

More specifically, the first and second auxiliary frame are hinged to each other, (in one embodiment by a further universal joint), to enable the first and second auxiliary frame to pitch and roll with respect to each other.

The first and second auxiliary frame are also connected elastically to each other in a direction parallel to the longitudinal axis.

This elastic connection also enables movements substantially parallel to the longitudinal axis, so that two adjacent cars on the same bogie can move to and from each other.

In one embodiment, the first and second auxiliary frame each have two connecting points to a respective car.

In one embodiment of the present disclosure, the bogie comprises lateral rollers, each connected elastically to the main frame to push the lateral roller outwards.

This configuration reduces lateral movement of the bogie, especially around bends.

In one embodiment, each lateral roller is actually connected to the main frame by an arm hinged to the main frame.

The present disclosure also relates to a cable passenger transportation system configured for a relatively high degree of passenger comfort.

According to the present disclosure, there is provided a cable passenger transportation system, the system comprising a train comprising at least one car, and wherein each car is supported on two bogies, each as claimed in any one of the foregoing claims.

In one embodiment of the present disclosure, the train comprises at least two cars, and at least one bogie supports two cars.

In one embodiment, the c able passenger transportation system comprises at least one haul cable; and a coupling device configured to connect the train to the haul cable. The coupling point of the coupling device is offset with respect to the longitudinal axis of the bogie.

This configuration enables the cable transportation system to be equipped with two haul cables, which, in one embodiment, are operated in opposite directions.

The train may be connected to the haul cable by the bogie, by a coupling device fitted to the bogie, or by a coupling device fitted directly beneath the car.

It should be appreciated that neither of the above coupling configurations involves alterations to the bogie, and the articulated mechanism is able to transfer pulling force from the frame to the platform and from the platform to the frame.

Additional features and advantages are described in, and will be apparent from, the following Detailed Description and the figures.

BRIEF DESCRIPTION OF THE DRAWINGS

A number of non-limiting embodiments of the present disclosure will be described by way of example with reference to the attached drawings, in which.

DETAILED DESCRIPTION

Figure 1:
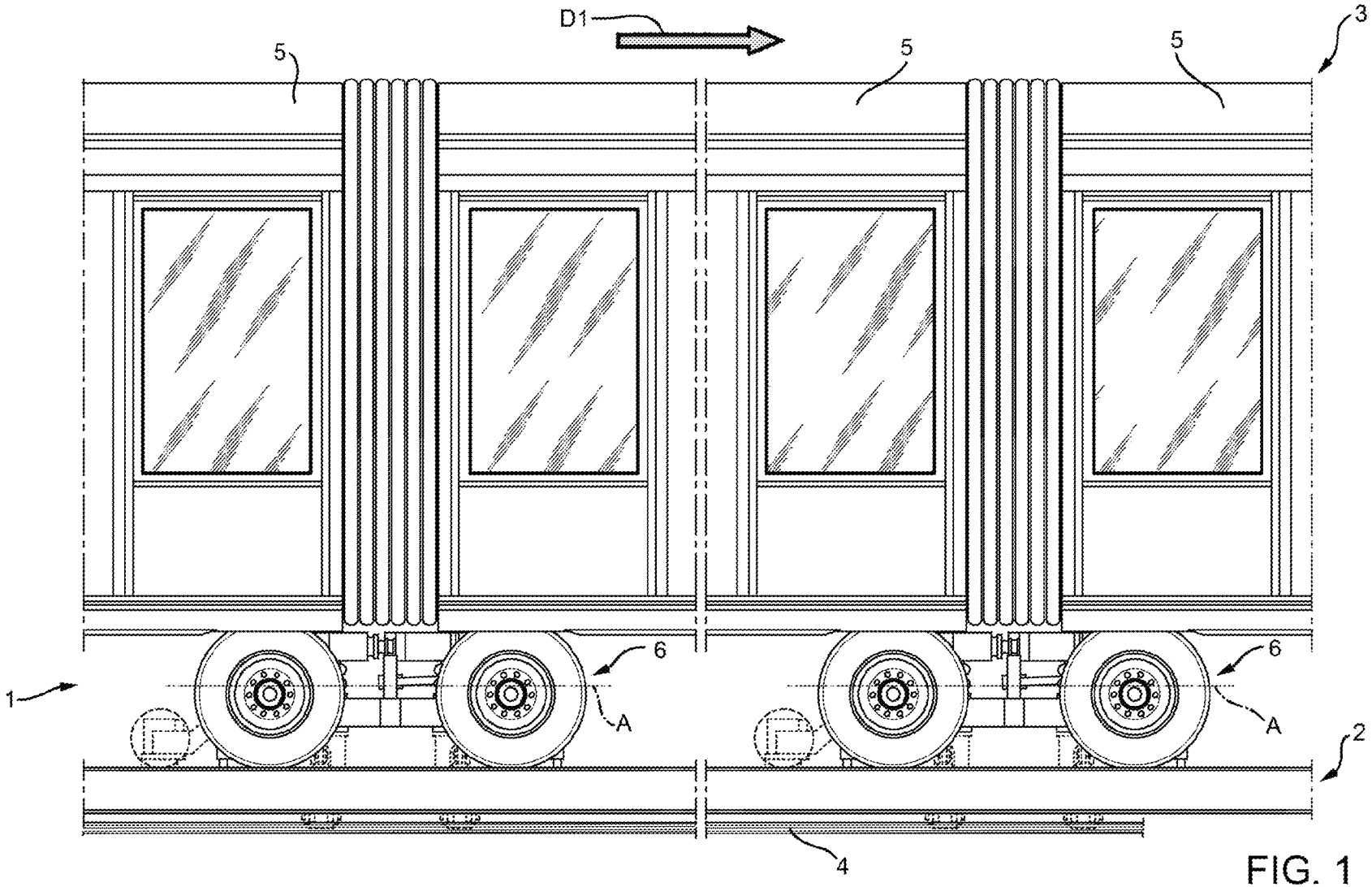
FIG. 1 shows a side view, with parts removed for clarity, of a cable transportation system employing bogies in accordance with the present disclosure.

Referring now to the example embodiments of the present disclosure illustrated in FIGS. 1 to 9, number 1 in FIG. 1 indicates as a whole a cable transportation system.

Cable transportation system 1 comprises a track 2; a train 3 on track 2; and a haul cable 4 configured to move train 3 along track 2. Train 3 comprises a plurality of cars 5, each configured to transport passengers, and each supported at opposite ends on two bogies 6. In the FIG. 1 example, each bogie 6 supports the adjacent ends of two communicating cars 5 connected in articulated manner by bogie 6.

Train 3 runs along the track in a direction D1 and in the opposite direction.

Figure 2:
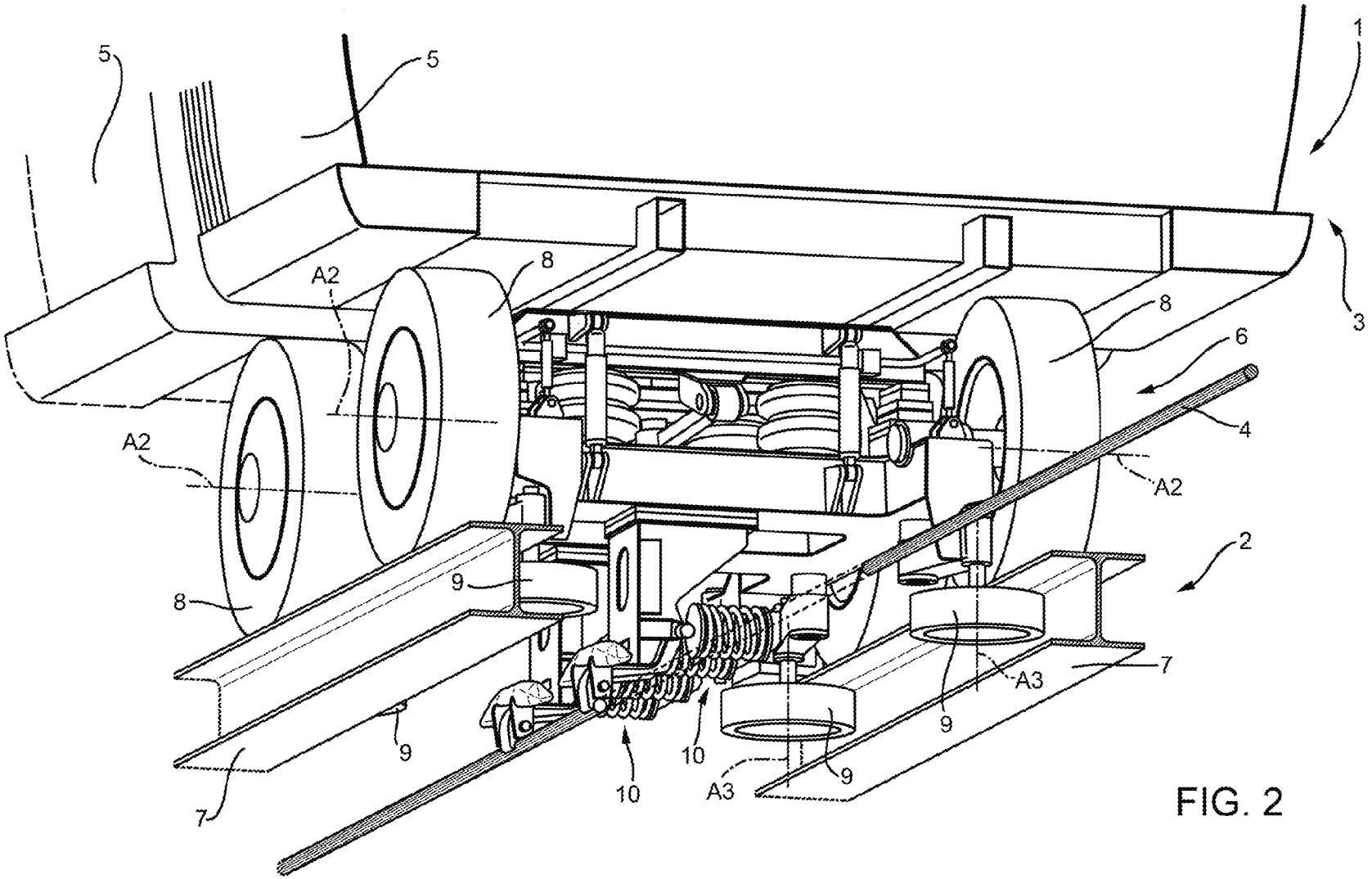
FIG. 2 shows a larger-scale view in perspective, with parts removed for clarity, of the FIG. 1 cable transportation system.

With reference to FIG. 2, track 2 is defined by two parallel rails 7. In one embodiment, each rail 7 is defined by an HE beam. In one embodiment, bogie 6 comprises four wheels 8, which rest on rails 7; and four lateral rollers 9 contacting the sides of rails 7. Wheels 8 rotate about respective axes A2. Lateral rollers 9 rotate about respective axes A3. Bogie 6 comprises coupling devices 10 configured to connect bogie 6 to haul cable 4. In the example shown, bogie 6 comprises two fixed-clamping coupling devices 10 with a cable coupling point offset with respect to the centerline of bogie 6.

In another embodiment (not shown in the drawings), the bogie is connected to the haul cable by a releasable coupling device.

Figure 3:
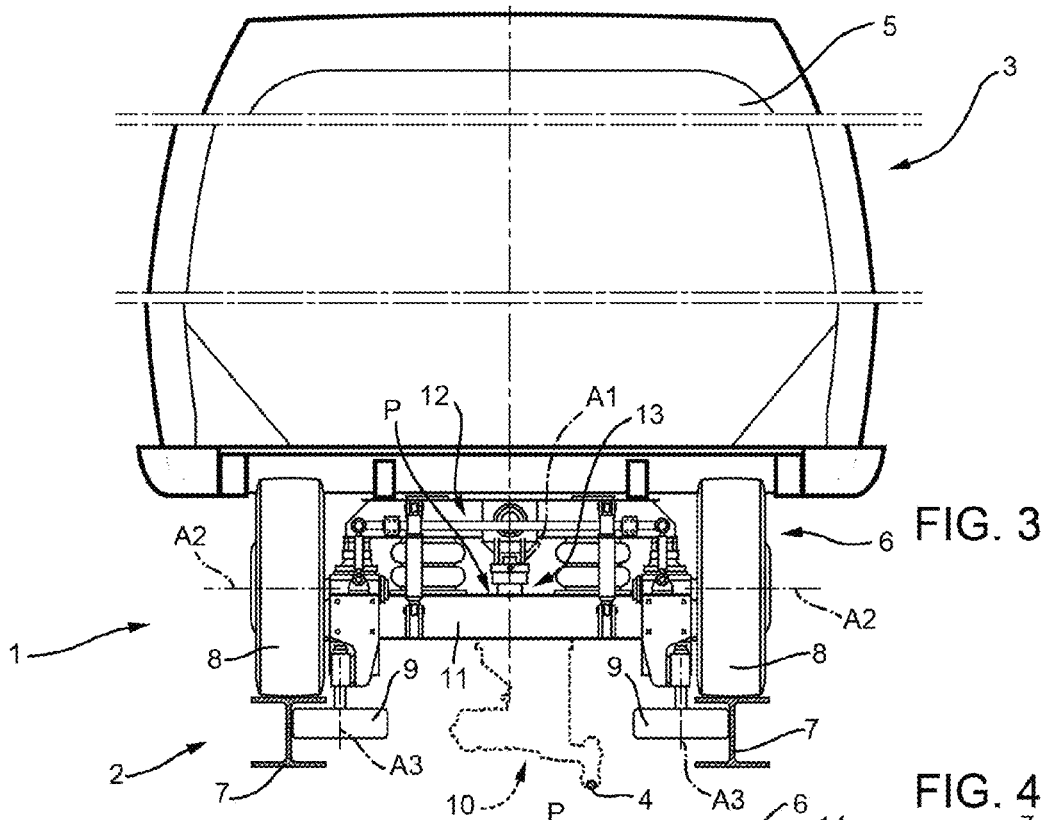
FIG. 3 shows a section, with parts removed for clarity, of the FIG. 1 system.

With reference to FIG. 3, bogie 6 extends along a longitudinal axis A1. Bogie 6 comprises a main frame 11 defining a supporting surface P; a platform 12 connectable to at least one car 5; and an articulated mechanism 13 connected to main frame 11 and platform 12, and configured to transmit pulling force between main frame 11 and platform 12. Articulated mechanism 13 also enables platform 12 to move with respect to main frame 11 with a plurality of degrees of freedom, and at the same time transmits pulling force effectively between haul cable 4 and car 5 in travelling direction D1.

Figure 4:
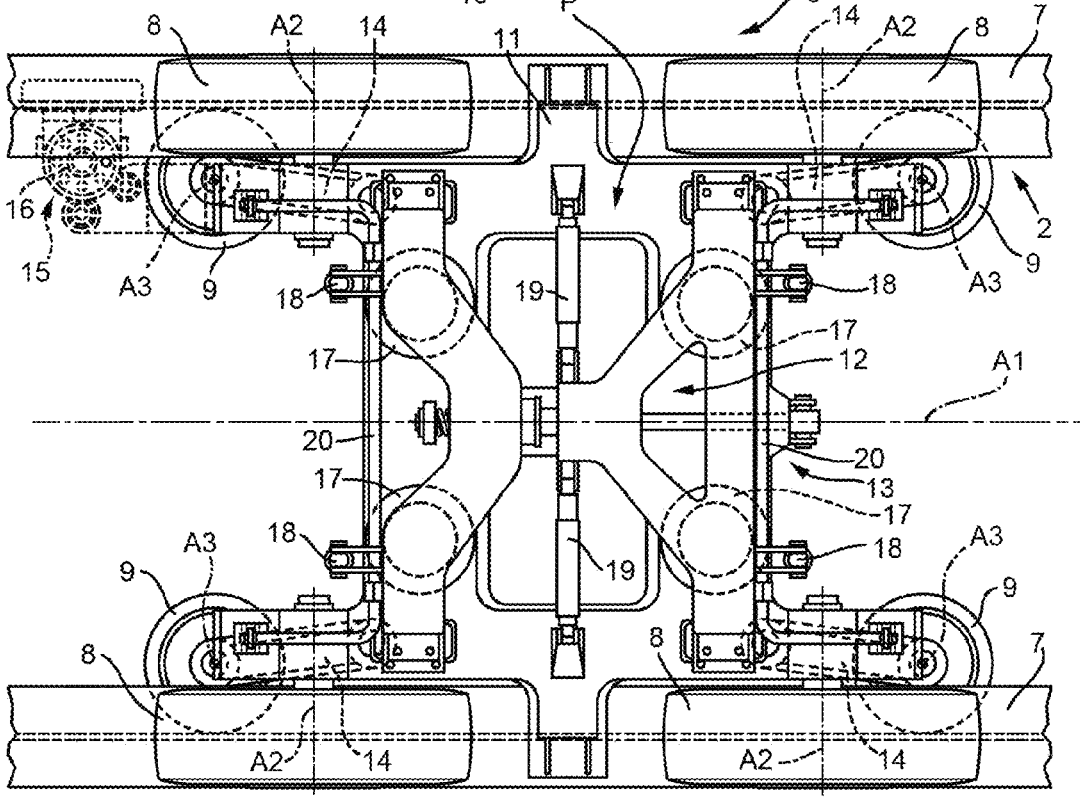
FIG. 4 shows a larger-scale plan view, with parts removed for clarity, of the FIG. 1 system bogie.

With reference to FIG. 4, main frame 11 supports wheels 8 about respective axes A2 parallel to supporting surface P, and lateral rollers 9 about respective axes A3 perpendicular to supporting surface P. Lateral rollers 9 are connected elastically to main frame 11 so as to exert outward thrust—in the example shown, against rails 7—to ensure bogie 6 engages and is positioned correctly with respect to rails 7.

Construction-wise, each lateral roller 9 is supported for rotation about respective axis A3 by an arm 14, in turn hinged to main frame 11. A spring (not shown in the drawings), serves to push arm 14 and lateral roller 9 outwards.

Bogie 6 also comprises a brake 15 fitted to main frame 11. Brake 15 interferes with a rail 7, and, in one embodiment, comprises a brake calliper 16 configured to grip part of rail 7.

Bogie 6 comprises a plurality of suspensions 17 between main frame 11 and platform 12. More specifically, bogie 6 has four (in one embodiment air-powered) selectively adjustable suspensions 17. Suspensions 17 are evenly distributed along main frame 11, and, in one embodiment, are at the corners of a rectangle. Suspensions 17 are configured to absorb forces perpendicular to supporting surface P.

Bogie 6 comprises a plurality of shock absorbers 18 configured to decelerate movements perpendicular to supporting surface P. More specifically, bogie 6 comprises four shock absorbers 18, each located next to a respective suspension 17 and hinged at the ends to main frame 11 and platform 12.

Bogie 6 comprises a plurality of lateral shock absorbers 19 configured to decelerate movement, crosswise to longitudinal axis A1 and substantially parallel to supporting surface P, between platform 12 and the main frame. More specifically, bogie 6 comprises two lateral shock absorbers 19, each connecting main frame 11 to platform 12, and each having two ends hinged to main frame 11 and platform 12 respectively.

Bogie 6 comprises at least one and, in one embodiment, two torsion bars 20, as shown in the attached drawings. Each torsion bar 20 is connected to main frame 11 and platform 12, and serves to limit roll of platform 12 with respect to main frame 11.

Figure 5:
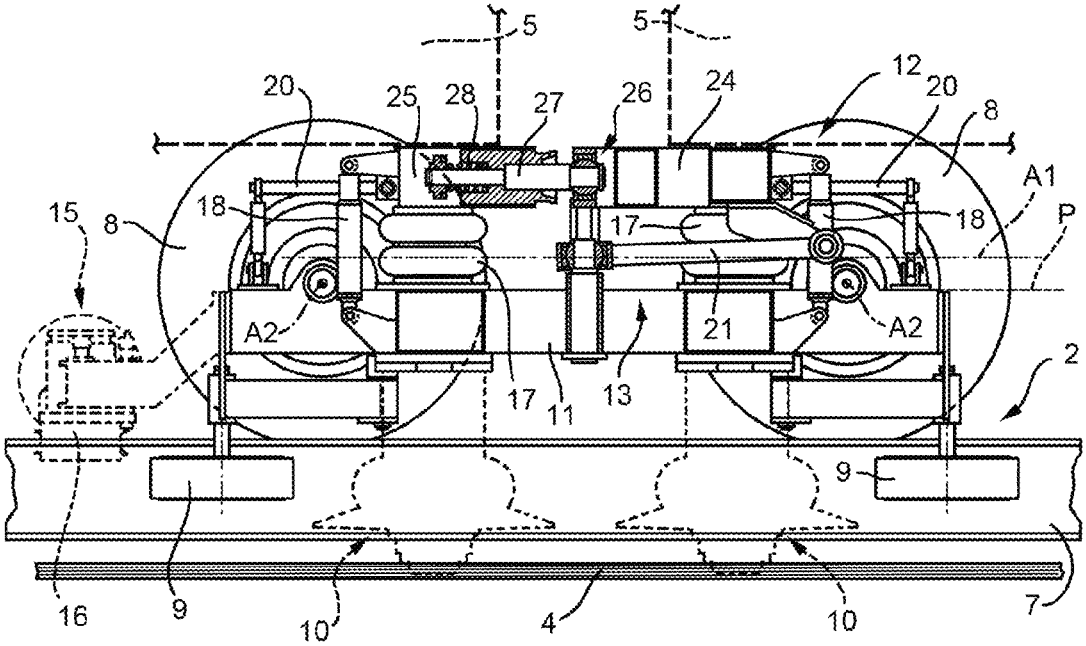
FIG. 5 shows a section, with parts removed for clarity, of the FIG. 4 bogie.

With reference to FIG. 5, articulated mechanism 13 comprises a longitudinal bar 21 connected to main frame 11 and platform 12 by two respective universal joints 22 and 23.

Figure 6:
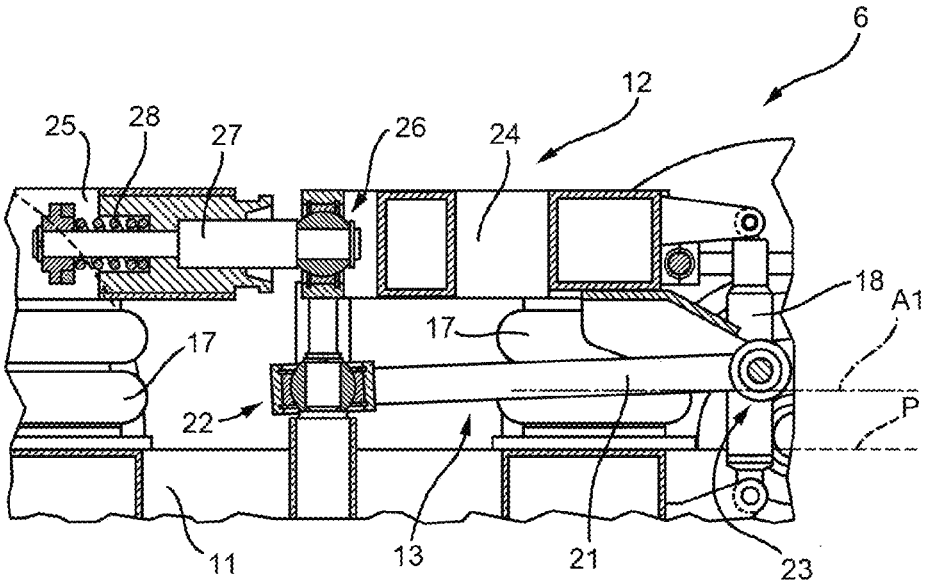
FIG. 6 shows a larger-scale section, with parts removed for clarity, of a detail of the FIG. 5 bogie.

As shown more clearly in FIG. 6, platform 12 comprises two auxiliary frames 24 and 25 configured to respectively support two adjacent cars 5 arranged successively along longitudinal axis A1.

Each auxiliary frame 24, 25 is connected to two suspensions 17, two shock absorbers 18, and a torsion bar 20. Auxiliary frame 24 is also connected to lateral shock absorbers 19 (FIG. 4) and to articulated mechanism 13.

Auxiliary frames 24 and 25 are also connected to each other.

As shown more clearly in FIG. 6, auxiliary frames 24 and 25 are, in one embodiment, hinged to each other by a universal joint 26.

Auxiliary frames 24 and 25 are connected elastically to each other in a direction parallel to longitudinal axis A1.

More specifically, a pin 27 configured to connect auxiliary frames 24 and 25 extends parallel to longitudinal axis A1, and has one end connected to auxiliary frame 24 by universal joint 26, and the other end fitted to auxiliary frame 25 to slide parallel to it and with the interposition of a spring 28.

Figure 7:
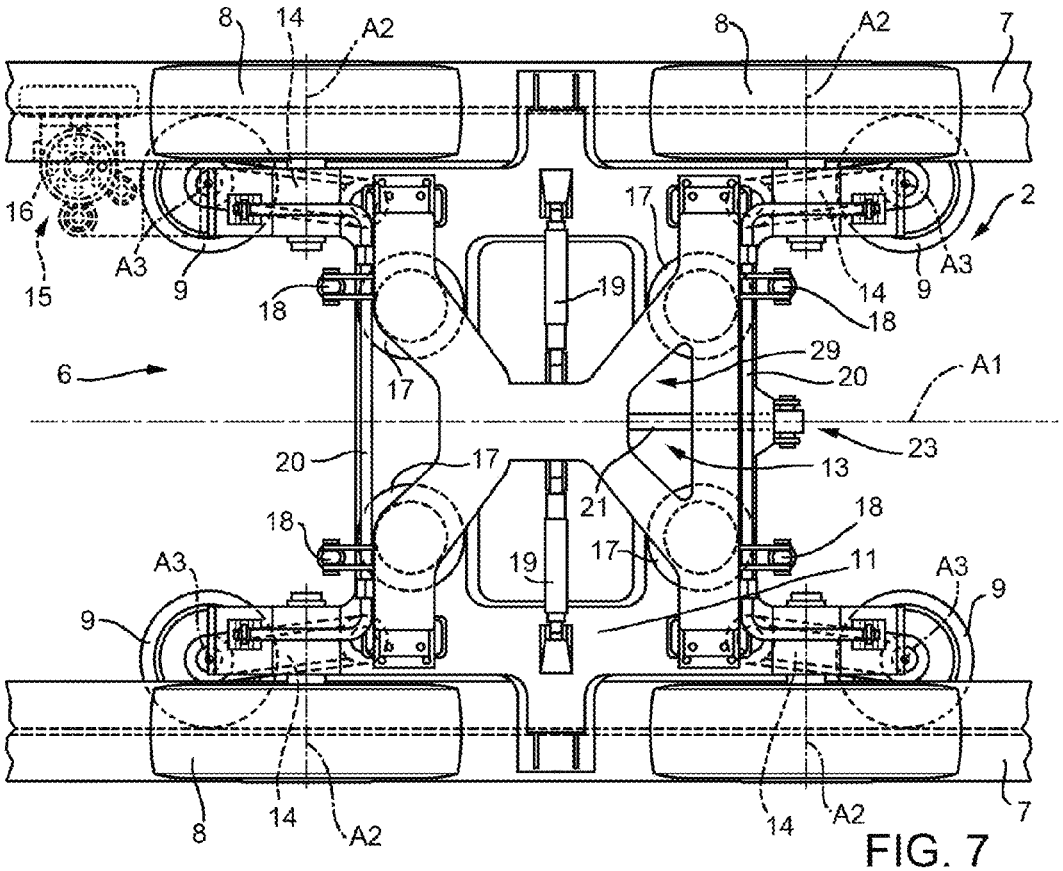
FIGS. 7 and 8 show a plan view and section respectively, with parts removed for clarity, of a bogie in accordance with a variation of the present disclosure.
Figure 8:
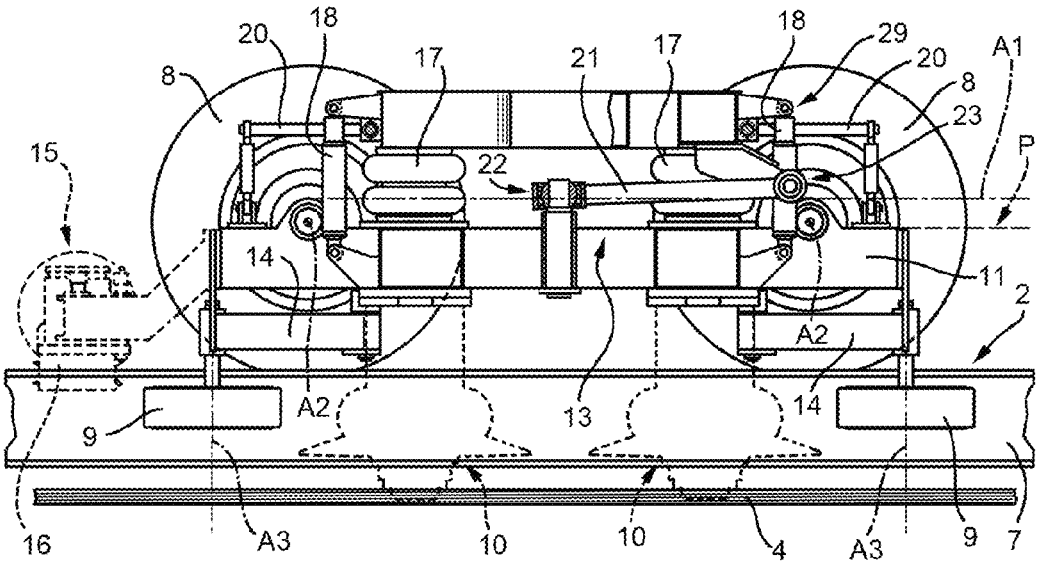

In the FIGS. 7 and 8 variation, bogie 6 is equipped with a one-piece platform 29.

In this configuration, bogie 6 is connected to only one car 5 (FIG. 1).

Figure 9:
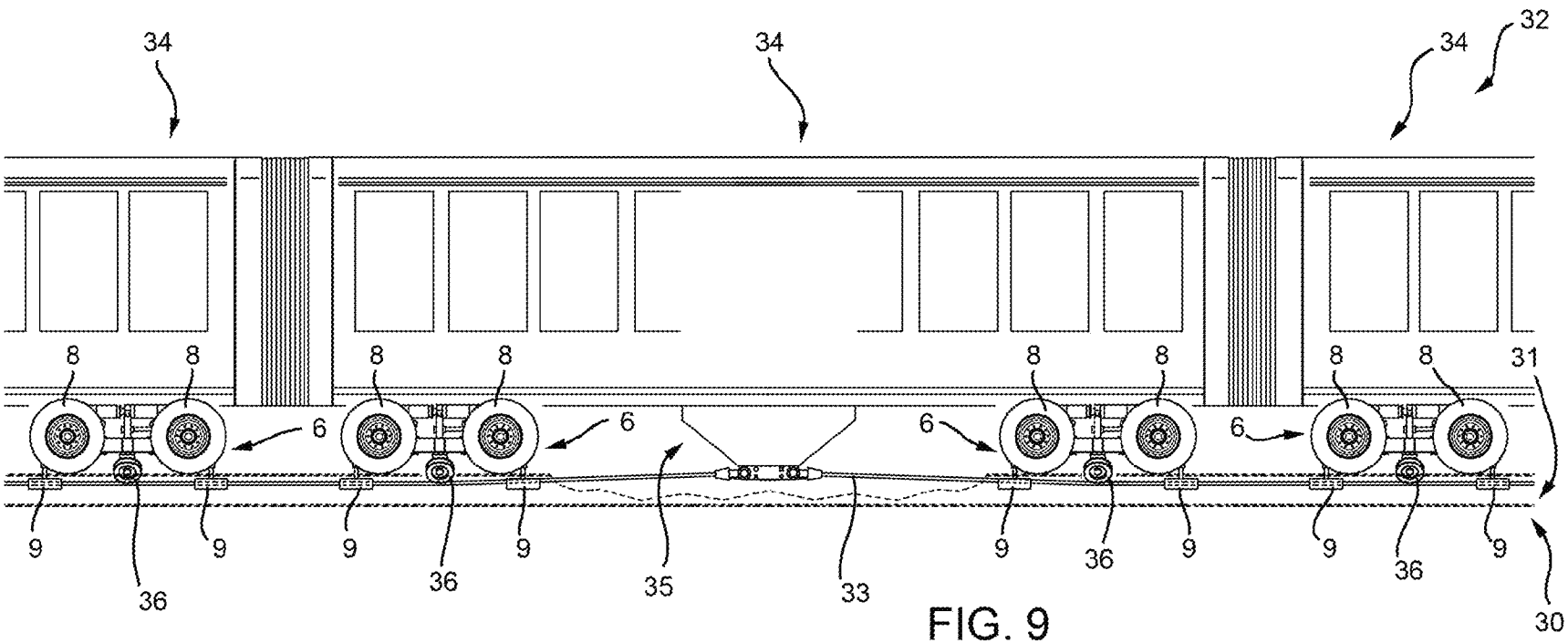
FIG. 9 shows a side view, with parts removed for clarity, of a cable transportation system in accordance with an alternative embodiment of the present disclosure.

Number 30 in the FIG. 9 embodiment indicates a cable transportation system comprising a track 31; a train 32 on track 31; and a haul cable 33 configured to move train 32 along track 31. Train 32 comprises a plurality of cars 34, each configured to transport passengers, and each supported at opposite ends on two bogies 6. In the FIG. 1 example, each bogie 6 only supports one car 34.

One of cars 34 comprises a coupling device 35 configured to connect train 32 to haul cable 33. Each bogie 6 is equipped with vertical and/or horizontal and/or inclined deviator systems 36 for the haul cable 33.

Clearly, changes may be made to the bogie and system as described and claimed, without, however, departing from the scope of the accompanying Claims and without diminishing its intended advantages. It is therefore intended that such changes and modifications be covered by the appended claims.

The invention is claimed as follows:

1. A cable transportation system bogie extending along a longitudinal axis, said cable transportation system bogie comprising:
- a main frame defining a supporting surface;
- a platform located over the main frame and configured to support at least one car; and
- an articulated mechanism connected to the main frame and the platform, said articulated mechanism configured to simultaneously:
  - (i) transmit pulling force between the main frame and the platform, and
  - (ii) permit movement of the platform with respect to the main frame in any direction.

2. The cable transportation system bogie of claim 1, which includes a plurality of suspensions located between the main frame and the platform, said plurality of suspensions being configured to: (i) absorb a plurality of forces perpendicular to the supporting surface, and (ii) adjust the platform with respect to the main frame.

3. The cable transportation system bogie of claim 1, which includes a plurality of shock absorbers located between the main frame and the platform, said plurality of shock absorbers being configured to decelerate movements, perpendicular to the supporting surface, between the main frame and the platform.

4. The cable transportation system bogie of claim 1, which includes a plurality of lateral shock absorbers located between the main frame and the platform, said plurality of lateral shock absorbers being configured to decelerate movements, crosswise to the longitudinal axis and parallel to the supporting surface, between the platform and the main frame.

5. The cable transportation system bogie of claim 1, which includes at least one torsion bar, each torsion bar being connected to the main frame and the platform.

6. The cable transportation system bogie of claim 1, wherein the articulated mechanism includes a longitudinal bar connected to the main frame and the platform by two respective universal joints.

7. The cable transportation system bogie of claim 1, wherein the platform includes a first auxiliary frame and a second auxiliary frame arranged successively along the longitudinal axis to support a first car and a second car, respectively.

8. The cable transportation system bogie of claim 1, which includes a plurality of lateral rollers, each of the plurality of lateral rollers being connected elastically to the main frame to push the lateral roller outwards.

9. The cable transportation system bogie of claim 8, wherein each lateral roller is connected to the main frame by an arm hinged to the main frame.

10. A cable passenger transportation system comprising:
- a train including at least one car; and
- two bogies, each bogie including:
  - a main frame defining a supporting surface,
  - a platform located over the main frame and configured to support the at least one car of the train, and
  - an articulated mechanism connected to the main frame and the platform, said articulated mechanism configured to simultaneously:
    - (i) transmit pulling force between the main frame and the platform, and
    - (ii) permit movement of the platform with respect to the main frame in any direction.

11. The cable passenger transportation system of claim 10, wherein the train includes at least two cars, wherein at least one of the two bogies supports the at least two cars.

12. The cable passenger transportation system of claim 10, which includes:
- at least one haul cable, and
- a coupling device configured to connect the train to the haul cable.

13. The cable passenger transportation system of claim 12, wherein a coupling point of the coupling device is offset with respect to a longitudinal axis which the two bogies extend along.

14. The cable passenger transportation system of claim 12, wherein the coupling device is mounted on the main frame of at least one of the bogies.

15. The cable passenger transportation system of claim 12, wherein the coupling device is mounted on the at least one car.

16. A cable transportation system bogie extending along a longitudinal axis, said cable transportation system bogie comprising:
- a main frame defining a supporting surface;
- a platform located over the main frame and configured to support at least one car; and
- an articulated mechanism includes a longitudinal bar connected to the main frame and the platform by two respective universal joints, said articulated mechanism configured to:
  - (i) transmit pulling force between the main frame and the platform, and
  - (ii) permit movement of the platform with respect to the main frame in any direction.

17. A cable passenger transportation system comprising:
- a train including at least one car; and
- two bogies, each bogie including:
  - a main frame defining a supporting surface,
  - a platform located over the main frame and configured to support the at least one car of the train, and an articulated mechanism includes a longitudinal bar connected to the main frame and the platform by two respective universal joints, said articulated mechanism configured to:

(i) transmit pulling force between the main frame and the platform, and (ii) permit movement of the platform with respect to the main frame in any direction.

18. A cable transportation system bogie extending along a longitudinal axis, said cable transportation system bogie comprising:

a main frame defining a supporting surface;

a platform located over the main frame and including a first auxiliary frame hinged to a second auxiliary frame, said first auxiliary frame and the second auxiliary frame arranged successively along the longitudinal axis, said first auxiliary frame configured to support a first car and said second auxiliary frame configured to support a second car; and an articulated mechanism connected to the main frame and the platform, said articulated mechanism configured to:

(i) transmit pulling force between the main frame and the platform, and (ii) permit movement of the platform with respect to the main frame in any direction.

19. A cable transportation system bogie extending along a longitudinal axis, said cable transportation system bogie comprising:

a main frame defining a supporting surface;

a platform located over the main frame and including a first auxiliary frame and a second auxiliary frame arranged successively along the longitudinal axis, wherein a universal joint hinges the first auxiliary frame to the second auxiliary frame, said first auxiliary frame is configured to support a first car and said second auxiliary frame is configured to support a second car; and an articulated mechanism connected to the main frame and the platform, said articulated mechanism configured to:

(i) transmit pulling force between the main frame and the platform, and (ii) permit movement of the platform with respect to the main frame in any direction.

20. A cable transportation system bogie extending along a longitudinal axis, said cable transportation system bogie comprising:

a main frame defining a supporting surface;

a platform located over the main frame and including a first auxiliary frame and a second auxiliary frame arranged successively along the longitudinal axis, wherein the first auxiliary frame and the second auxiliary frame are connected elastically to each other in a direction parallel to the longitudinal axis, said first auxiliary frame is configured to support a first car and said second auxiliary frame is configured to support a second car; and an articulated mechanism connected to the main frame and the platform, said articulated mechanism configured to:

(i) transmit pulling force between the main frame and the platform, and (ii) permit movement of the platform with respect to the main frame in any direction.

21. A cable transportation system bogie extending along a longitudinal axis, said cable transportation system bogie comprising:

a main frame defining a supporting surface;

a platform located over the main frame and including a first auxiliary frame and a second auxiliary frame arranged successively along the longitudinal axis, said first auxiliary frame configured to support a first car, said second auxiliary frame configured to support a second car, and the first auxiliary frame and the second auxiliary frame each have two connecting points to a respective one of the cars; and an articulated mechanism connected to the main frame and the platform, said articulated mechanism configured to:

(i) transmit pulling force between the main frame and the platform, and (ii) permit movement of the platform with respect to the main frame in any direction.

* * * * *